United States Patent [19]

Yanazawa et al.

[11] 4,402,206

[45] Sep. 6, 1983

[54] METHOD OF ROLLING SLABS FOR THE MANUFACTURE OF BEAM BLANKS AND A ROLL TO BE USED THEREFOR

[75] Inventors: Tadaaki Yanazawa; Teruaki Tanaka; Masashi Yamashita; Takashi Ehiro; Hiroshi Okumura; Shinzo Saito; Takashi Kusaba, all of Kurashiki, Japan

[73] Assignee: Kawasaki Steel Corporation, Kobe, Japan

[21] Appl. No.: 266,310

[22] Filed: May 20, 1981

[30] Foreign Application Priority Data

Mar. 5, 1981 [JP] Japan ..... 56-31508

[51] Int. Cl.[3] ..... B21B 1/08

[52] U.S. Cl. ..... 72/221; 72/366

[58] Field of Search ..... 72/221, 222, 226, 228, 72/234, 235, 365, 366

[56] References Cited

U.S. PATENT DOCUMENTS 4,086,801 5/1978 Nakajima et al. ..... 72/234

4,362,041 12/1982 Nakanishi et al. ..... 72/221

FOREIGN PATENT DOCUMENTS 53-8308 3/1978 Japan ..... 72/221

56-41002 4/1981 Japan ..... 72/221

*Primary Examiner*—Francis S. Husar

*Assistant Examiner*—Jonathan L. Scherer

*Attorney, Agent, or Firm*—Balogh, Osann, Kramer, Dvorak, Genova & Traub

[57] ABSTRACT

A method of rolling raw materials inclusive of slabs for the manufacture of beam blanks, and a roll to be used therefor, are disclosed. This method includes the steps of (a) subjecting a raw material, whose section consists of a web portion and a flange portion(s) having a width wider than the thickness of the web portion, to such a partial rolling that the web portion is partially rolled at regions inclusive of at least the joints of the flange portion(s), except the remaining central region, among a plurality of regions divided in the widthwise direction of the web portion, and (b) subjecting only the remaining central regions to a rolling. In the practice of this method, there is used a roll consisting of a single cylindrical drum including a first segment and a second segment arranged side by side to each other; the first segment having at least one relief of circumferential grooves facing the web portion; a plurality of rolling collars separated apart from each other through the relief in the axial direction, and serving for the partial rolling of the web portion, and a circumferential groove(s) dividing a side of the rolling collar for the web portion near the joint and enclosing the flange portion; and the second segment having a pair of reliefs each composed of a wider circumferential groove facing the flange portion, and a rolling drum extending between the reliefs and serving for the rolling of only the remaining central region of the web portion.

5 Claims, 18 Drawing Figures

METHOD OF ROLLING SLABS FOR THE MANUFACTURE OF BEAM BLANKS AND A ROLL TO BE USED THEREFOR

This invention relates to a method of rolling raw materials inclusive of slabs for the manufacture of beam blanks and a rolling roll to be used therefor.

Lately, sectional steels such as H-beams, I-beams and others, particularly large ones have mainly been manufactured with universal mills from so-called beam blanks prepared by rolling blooms, beam blanks, ingots or slabs, at breakdown rolling or by a continuous casting step.

The beam blanks are prepared by breakdown rolling of an ingot or by continuous casting. However, the beam blanks may include materials to be used in the rough rolling after the breakdown rolling or in the finish rolling in addition to materials used in the breakdown rolling, so that the definition of beam blank is not necessarily clear. In the invention, materials to be supplied to a rolling stage for sectional steel products using the above universal mill are particularly designated as a beam blank. Especially, the invention provides a rolling method for the shaping of the beam blank and a rolling roll to be used therefor.

In the shaping of the beam blank according to the invention, there are used raw materials, each sectional shape of which consists of a web portion and a flange portion(s) having a width fairly wider than a thickness of the web portion. They are usually prepared by the breakdown rolling or continuous casting. If it is intended to manufacture super-large sectional steels having a large sectional shape, it is frequently difficult to perform the shaping of the raw material itself. However, the invention can advantageously overcome such a difficulty and is more suitable to shape slabs having a width fairly narrower than the conventionally required one into beam blanks having a sectional shape equal to or better than the predetermined one.

In general, the continuous casting process realizes conspicuous improving effects as compared with the breakdown rolling process in view of energy-saving and yield increase. Particularly, the continuous cast slabs not only have sufficiently improved surface and inner qualities as apparent from actual results of steel plates, but also can fairly easily be prepared as compared with blooms having a ratio of width to thickness smaller than that of the slab or beam blanks having a heterogeneous sectional shape. Furthermore, the slab is easily shaped into a so-called dog bone section by rolling it in the widthwise direction to form bulged portions at side edges, i.e. by a preliminary edge-rolling, which can be used as a slab for the manufacture of beam blanks. In this edge-rolling, however, the reduction of web width is followed by the expanding of flange width, so that it is necessary to use a slab having a wider width if it is intended to manufacture super-large size sectional steels, but it is still difficult to produce such a widened slab by the continuous casting process.

As to the rolling of the flange portion, some of the inventors have previously filed a method of shaping beam blanks in Japanese Patent Application No. 117,026/79, the essence of which will be described below.

That is, a slab 1 shown in FIG. 1 is rolled into a beam blank 8 for H-beam shown in FIG. 2 according to a rolling schedule as shown in FIG. 3. At first, the slab 1 is turned from the state shown in FIG. 1 by 90° and then rolled in the widthwise direction of the slab 1 by a pair of box calibers 12, each being provided at its bottom with a protrusion (or a belly) 13 and having a caliber width corresponding to the thickness of the slab, to produce a rolled material 2 having a V-shaped recess 9 at a center of each short side of the slab as shown in FIG. 3*a*. Next, the material 2 is rolled up to a predetermined height H′ in several passes by a pair of box calibers 14, each having a caliber width wider than that of the caliber 12 and being provided with a belly 15 of substantially the same shape as that of the belly 13, while guiding the V-shape recess 9 of the material 2 with the belly 15 to prevent the inclining or falling of the material 2 as shown in FIG. 3*b*, to produce a rolled material 4 having such a cross section that the flange portions located in top and bottom of FIG. 3*b* are rolled. Thereafter, the material 4 is edge-rolled by a pair of flat calibers 14′ as shown in FIG. 3*c* to produce a rolled material 7 having no V-shape recess 10 of the material 4. Finally, the material 7 is turned around 90° and then rolled into the beam blank 8 by a pair of shaping calibers 6 as shown in FIG. 3*d*.

If it is intended to manufacture large sectional steels having a higher web height, the beam blank 8 is required to have a higher web height H″, so that the above illustrated method is necessary to use a slab having a wider width H. In order to roll such a slab having a wide width H in the widthwise direction, however, the lifting amount of the roll becomes larger, so that a large size rolling mill must be used. Moreover, since the thickness/width ratio (B/H) of the slab under the widthwise rolling is small, the slab is apt to fall down and also the number of edge-rolling passes becomes larger.

On the other hand, when a slab having a larger thickness B is used in order to increase the thickness/width ratio, the pass number for the rolling of the web portion by the shaping caliber becomes larger, during which the temperature of the rolled material lowers. As a result, it is necessary to reheat the material during the rolling at subsequent finish steps using a universal roll mill. For instance, the beam blank used for the manufacture of H-beams having a web height of 700 mm and a flange width of 300 mm [hereinafter referred to as (H700×300)] is necessary to have a web height of about 900 mm. In order to prepare this beam blank by the rolling schedule shown in FIG. 3, it is necessary to use a slab having a width of about 1,500 mm. In this case, the draft of about 600 mm is obtained at about 20 edge-rolling passes, during which the temperature drop of the rolled material becomes conspicuous, so that it is impossible to manufacture the sectional steel product from the slab by one-heat rolling and hence the reheating of the material is always required in the course of the rolling.

As mentioned above, when the beam blank for large sectional steel having a higher web height is manufactured from the slab, even if an effective rolling means is applied at the steps of expanding the flange width, the rolling of the slab in the widthwise direction produces a large reduction of the web height and as a result, there are caused troubles in the rolling equipment and operation. In this connection, the inventors have made further investigations, and found the following. That is, when the web portion is rolled in the thickness direction to reduce web thickness, if the raw material is subjected to the rolling over the whole, the rolled-out volume extends in the lengthwise direction. However, if only a part of the web portion is rolled in a stripe form, the extension of rolled-out volume in the lengthwise direction is restrained because the rolled region is integrally united with the remaining non-rolled region. As a result, the rolled-out volume extends in the width-wise direction at the non-rolled region to raise web height, so that the rolling can be again performed in the height direction (or widthwise direction) of the web portion, whereby the flange width can be expanded. Here, the process of rolling only a part of the web portion is called a partial stripe rolling.

According to the invention, the rolling during the reduction of web thickness is performed by selectively applying the partial stripe rolling to the web portion along plural regions inclusive of at least joints of flange portions among a plurality of regions divided in the widthwise direction of the web portion and then applying a secondary rolling to the remaining non-rolled regions other than the partially rolled regions, whereby the stretching of the web portion in the lengthwise direction is effectively restrained by regions not subjected to the rolling of each step.

Therefore, the invention is advantageously applicable to slabs, each sectional shape of which consists of a web portion and a flange portion(s) having a width wider than the thickness of the web portion, as well as the case in which the slab is subjected to a preliminary edging for forming bulged portions at side edges under the rolling in the widthwise direction. That is, beam blanks can advantageously be obtained by applying the invention to a rolling step requiring the rolling of the web portion.

Furthermore, the invention is also applicable to a general rolling step requiring the rolling of both web and flange portions in order to more advantageously prepare beam blanks. In this case, after the web portion is rolled as described above, the flange portions are subjected to an edge-rolling by pressing the flange portions toward the web portion to further roll the flange portion.

A method of rolling raw materials inclusive of the manufacture of beam blanks and a rolling roll to be used therefor can be summarized as follows:

1. A method of rolling raw materials inclusive of slabs for the manufacture of beam blanks, which includes the steps of
   (a) subjecting a raw material, whose section consisting of a web portion and a flange portion(s) having a width wider than the thickness of said web portion to such a partial rolling that the web portion is partially rolled at regions inclusive of at least joints of the flange portions except the remaining central region among a plurality of regions divided in the widthwise direction of said web portion and
   (b) subjecting only the remaining central region to a rolling without rolling the regions rolled in the above step (a).
2. A method of rolling raw materials inclusive of slabs for the manufacture of beam blanks, which includes the steps of
   (a) subjecting a raw material, whose section consisting of a web portion and a flange portion(s) having a width wider than the thickness of said web portion to such a partial rolling that the web portion is partially rolled at regions inclusive of at least joints of the flange portions except the remaining central region among a plurality of regions divided in the widthwise direction of said web portion;
   (b) subjecting only the remaining central region to a rolling without rolling the regions rolled in the above step (a);
   (c) subjecting said flange portion to a rolling by pressing said flange portion toward the web portion; and
   (d) repeating each of the steps (a), (b) and (c) at one or more passes.
3. In the method of the item 2, the raw materials is one obtained by subjecting a slab from breakdown rolling or continuous casting to a preliminary edging for forming a bulged portion along each side edge of the slab.
4. In the method of the item 2, the raw material is one obtained by subjecting a slab from breakdown rolling or continuous casting to a preliminary edging for forming a V-shape recess equally dividing the thickness of the slab and then forcing said V-shape recess open to form a bulged portion along each side edge of the slab.
5. In the method of the item 2, said partial rolling serves for a shaping caliber rolling of the flange portion.
6. A roll for rolling raw materials inclusive of slabs for the manufacture of beam blanks, which consists of a single cylindrical drum including a first segment and a second segment arranged side by side to each other; the first segment having at least one relief of circumferential grooves facing a web portion of a raw material having a sectional shape consisting of a web portion and a flange portion having a width wider than the thickness of the web portion, a plurality of rolling collars separated apart from each other through the relief in the axial direction and serving for such a partially striped rolling that the web portion is partially rolled at regions inclusive of at least joints of the flange portions except the remaining central region among a plurality of regions divided in the widthwise direction of the web portion and a circumferential groove(s) dividing a side of the rolling collar for the web portion near the jointand enclosing said flange portion; and the second segment having a pair of reliefs each composed of a wider circumferential groove facing the flange portion, and a rolling drum extending between said reliefs and serving for a rolling of the remaining central region of web portion.
7. In the roll of the item 6, the relief of the second segment comprises a caliber for rolling of the flange portion under the rolling of the web portion in the widthwise direction.

As mentioned above, when the web portion is rolled in the thickness direction by the combination of a first stage for rolling only regions of the web portion inclusive of the flange joint while, if necessary, shaping the flange portion and a second stage for rolling only the remaining convex part formed in the central region of the web portion, i.e. by two separate stages for selectively rolling individual regions of the web portion in the thickness direction, the stretching of the web portion in the lengthwise direction is restrained by the restriction of the non-rolled region at each stage to bring about the rolling of the web portion in the widthwise direction, whereby the web height can be enlarged. Further, by combining the above separate stage with another stage for edge-rolling the web portion in the direction of web height, the sectional area of the flange portion can be increased. Particularly, metal flow of the flange portion in the lengthwise direction (or the reduction of sectional area of the flange portion) can be decreased as far as possible as a result of the prevention of the lengthwise stretching at the separate rolling stages for web portion, and also rolling load can largely be reduced by the reduction of rolling area at the separate rolling stages.

Therefore, even when a slab having a width narrower than the lower limit in the conventional method is used as a raw material, the invention makes it possible to advantageously roll this slab into H-beams having a large sectional shape or the like.

The invention will now be described with reference to the accompanying drawings, wherein:

FIGS. 1 and 2 are diagrammatical sections of a slab and beam blank made therefrom, respectively;

FIGS. 3*a*–3*d* show a rolling schedule for advantageous rolling of flange portion as previously mentioned;

FIGS. 4*a* and 4*b* are diagrammatical views illustrating a preliminary edging step according to the invention;

Then, the invention will now be described in detail with reference to the following examples for the manufacture of beam blank for super-large H-beam from continuous cast slab.

Figure 1:
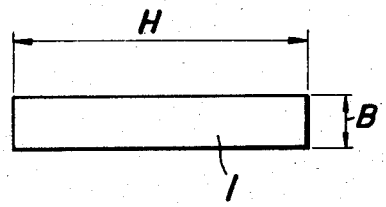
Figure 2:
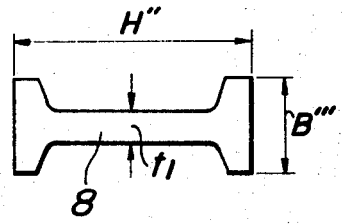
Figure 3A:
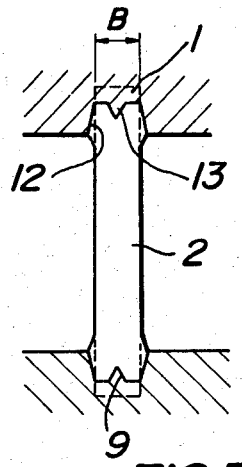
Figure 3B:
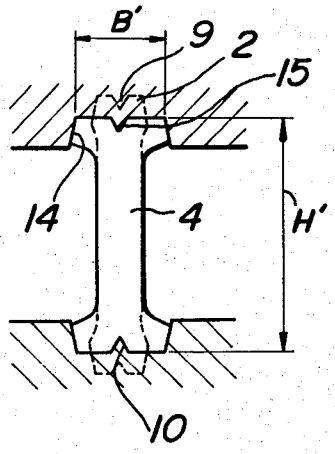
Figure 3C:
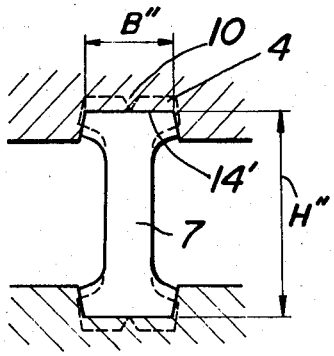
Figure 3D:
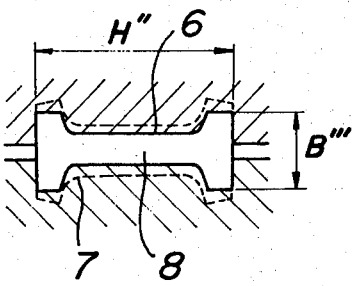
Figure 4A:
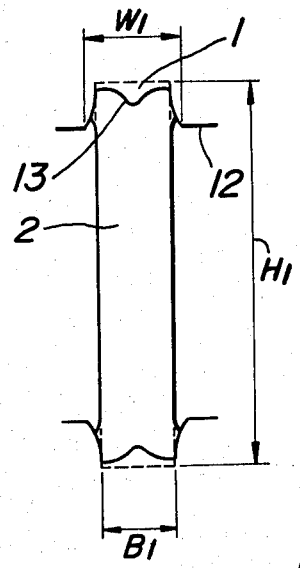

The rolling of a slab 1 in the widthwise direction is performed in the same manner as described in FIGS. 1 and 3*a*. That is, the slab 1 is rolled by a pair of box calibers 12 provided at their each bottom with a belly 13, while securing the centering with a V-shape recess 9 formed at each center of both short sides of the slab by the belly 13, to produce a rolled material 2. In order to accurately form the V-shape recess 9 in the center of each short side of the slab by the belly 13, the open width $W_1$ of the box caliber 12 is tapered in a range of $B_1+20$ mm with respect to the slab thickness $B_1$ as shown in FIG. 4*a*.

Figure 4B:
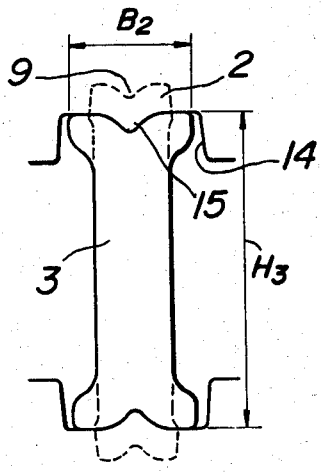

Then, the rolled material 2 is rolled up to a predetermined height $H_3$ in plural pass numbers by a pair of box calibers 14 provided at each bottom with a belly 15, while guiding the V-shape recess 9 with the belly 15 to prevent the inclining or falling of the material 2, to produce a rolled material 3 as shown in FIG. 4*b*.

When the draft per pass is small (the rolling reduction is not more than 6%), the stretching of the material 2 in the lengthwise direction is substantially prevented, while the material 3 is rolled near the contact surface with the roll to form a flange portion, a width of which is extended to $B_2$. In this case, the predetermined height $H_3$ is preferably 10–50 mm smaller than a width $W_2$ of a shaping caliber 17 as shown in FIG. 5 considering the contact with the caliber 17 and the rolling by the caliber 17.

Next, the material 3 is turned around 90° and passed through a pair of calibers 17 each comprising a pair of rolling collars 16 separated from each other by a relief 18 of a circumferential groove facing the central region of the web portion of the material 3, where the regions of the web portion inclusive of the joints of the flange portion are locally rolled at 4 places inside and outside the web portion. In this case, a circumferential groove 19 dividing the side of the rolling collar and enclosing the flange portion can perform the shaping of the flange portion. Therefore, the caliber 17 may serve as a shaping caliber.

Figure 5:
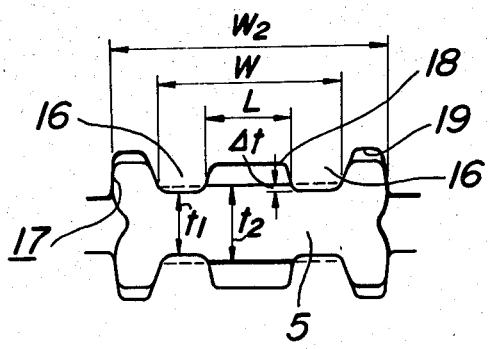
FIG. 5 is a diagrammatical view at a partial rolling stage.

When the web portion is locally rolled at regions inclusive of the flange joints other than the central region as shown in FIG. 5, the stretching of the rolled regions in the lengthwise direction is restrained by the flange portion and the central region of the web portion, not subjected to the rolling because the rolled regions are integrally united with the flange portion and the central region of the web portion and consequently metal flows from the rolled regions toward the flange portion and the central region of the web portion occur. As a result rolled material 5 having a non-rolled convex part at the central region of the web portion is formed without substantially reducing the sectional area of the flange portion and the flange width $B_2$. (In other words, when the rolled region is stretched in the lengthwise direction by rolling, the sectional area of the non-rolled region is naturally reduced, but when such a stretching in the lengthwise direction is restrained, the reduction of the section area of the non-rolled region is small.) Moreover, it is desirable from experimental results that as dimensions at the partially striped rolling of the web portion per pass, when the convex height is $\Delta t$, the bottom width of convex part is L and the inner width of the web portion is W, $\Delta t \leqq 50$ mm, $L \geqq 50$ mm and $L/W \leqq 0.5$. In this case, the depth of the relief 18 is necessary to be not less than 50 mm.

Figure 6:
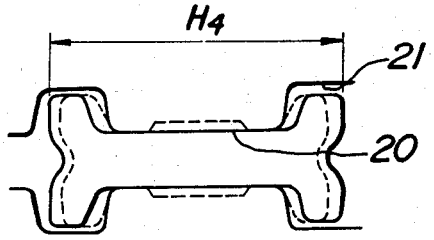
FIG. 6 is a diagrammatical view at a rolling stage for the rolling of flange portion.

Then only, the convex part formed at the central region of the web portion is rolled by a pair of rolling drums 20 as shown in FIG. 6. In this case, a pair of reliefs 21 each enclosing the flange portion are formed at both sides of the drum by cutting out a circumferential groove with a wider width from the drum. That is, when only the convex part is subjected to the rolling, the stretching of the web portion in the lengthwise direction is restrained by the previously rolled stripe regions of the web portion and the flange portion not subjected to the rolling at this stage, so that the rolled-out volume flows in the widthwise direction or the web portion is extended in a direction perpendicular to the lengthwise direction up to a web height $H_4$.

Figure 7:
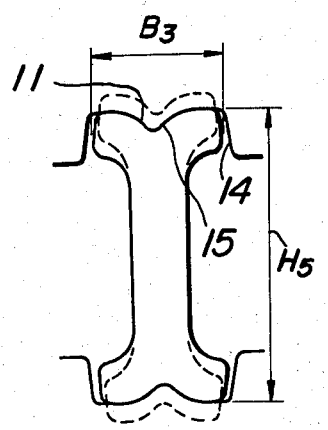
FIGS. 7 and 8 are diagrammatical views at an edge-rolling step of flange portion.

The web height $H_4$ is again reduced up to a predetermined height $H_5$ by passing the web portion through the box caliber 14 with the belly 15 as shown in FIG. 7, whereby the flange width can further be enlarged up to $B_3$. In the latter half pass for the rolling in the direction of web height, the V-shape recess 11 is eliminated from the outer surface of the flange portion by a pair of box calibers 14' each having a flat bottom as shown in FIG. 8 to produce a rolled material 7 having a web height $H_6$.

After the material 7 having desirable flange width, web thickness and web height is formed by repeating the rolling pass shown in FIG. 5→FIG. 6→FIG. 7 and then performing the latter half pass shown in FIG. 8, it is again passed through the shaping caliber 17, whereby only the flange portion is subjected to a shaping without applying a large rolling force to the regions of the web portion near the joint of the flange portion to thereby produce a rough sectional steel 8.

Thus, the combination of a pass for rolling the web portion in the web height direction by the caliber 14 to roll the flange portion, a pass for rolling only regions of the web portion near the joint of the flange portion by the rolling collar 16 of the caliber 17 (or the shaping of the flange portion) to form a convex part on the central region of the web portion, and a pass for rolling only the convex part by the rolling drum 20 to elongate the web height is repeated, during which the rolling reduction per each pass is regulated to roll the slab into a beam blank having predetermined flange width, web thickness and web height, whereby various beam blanks can be manufactured from a slab having a relatively narrow width without increasing the kind of the slab having a different width.

Figure 8:
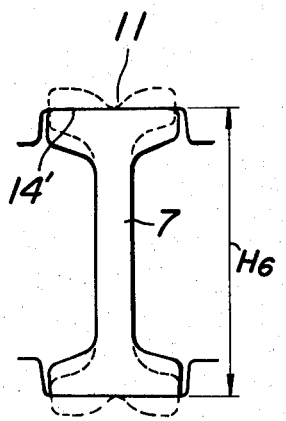
Figure 9:
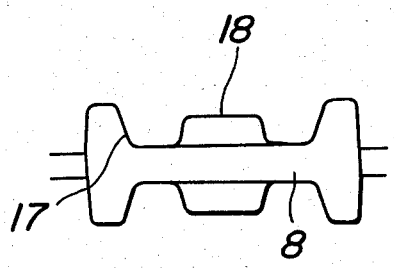
FIG. 9 is a diagrammatical view illustrating a shaping step for beam blank.

Furthermore, since the flange portion is sufficiently shaped prior to a final pass for shaping the flange portion at 4 places by the shaping caliber 17 as shown in FIG. 9, when the edging amount by the flat box caliber 14' of FIG. 8 is controlled to adjust the web height $H_6$, various beam blanks having different web heights can be manufactured through the single roll by the final pass.

As apparent from the above, a slab having a width narrower than that in the conventional slab rolling can be used, so that the number of initial edging passes becomes small (8 passes in case of H700×300, see the following Table 1). Moreover, the rolling reduction per pass can be made larger by separate rolling of the web portion and by free deformation under no restriction by caliber in the rolling of the convex part, so that the pass number can be decreased to prevent the temperature drop.

For instance, beam blank for H700×300 has been manufactured from a slab having a width of 1,500 mm by about 50 passes in the rolling method described in Japanese Patent Application No. 117,026/79, while it can be manufactured from a slab having a width of 1,225 mm by 31 passes according to the invention.

EXAMPLE A

Figure 10:
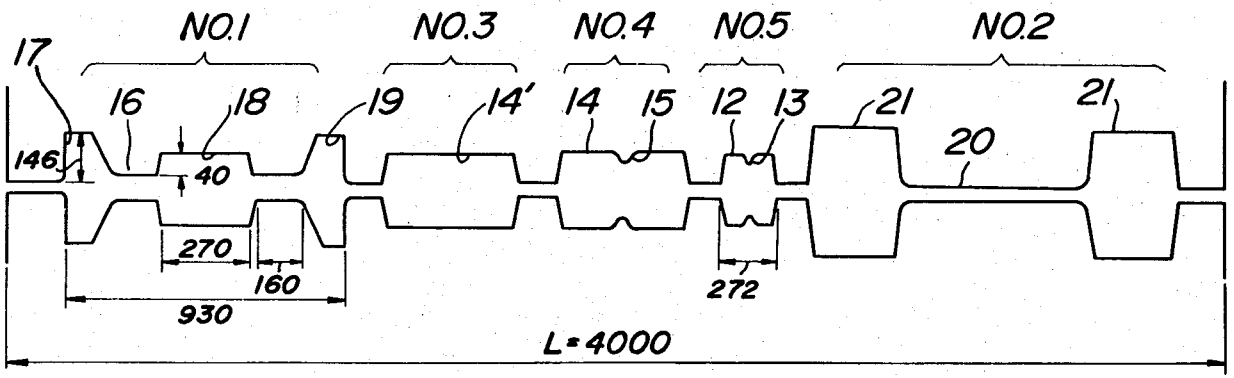
FIG. 10 is a schematic view of an embodiment in the pattern of the rolling roll according to the invention.

A beam blank for H700×300 was manufactured from a slab having a thickness of 250 mm and a width of 1,225 mm according to a pass schedule shown in Table 1. Moreover, a rolling roll used in this example is shown in FIG. 10.

TABLE 1(a)

| Pass No. | Caliber No. | Actual dimension: Web thickness $t_1$ (mm) | Web thickness $t_2$ (mm) | Web height (mm) | Flange width (mm) | Draft (mm) |
|---|---|---|---|---|---|---|
| 1 | 5 | 250 | | 1,220 | 253 | 5 |
| 2 | 5 | 250 | | 1,185 | 272 | 35 |
| 3 | 4 | 250 | | 1,145 | 294 | 40 |
| 4 | 4 | 250 | | 1,095 | 322 | 50 |
| 5 | 4 | 250 | | 1,045 | 349 | 50 |
| 6 | 4 | 250 | | 995 | 377 | 50 |
| 7 | 4 | 250 | | 950 | 401 | 45 |
| 8 | 4 | 250 | | 910 | 423 | 40 |
| 9 | 1 | 220 | | — | 422 | 30 |

TABLE 1(b)

| Pass No. | Caliber No. | Actual dimension: Web thickness $t_1$ (mm) | Web thickness $t_2$ (mm) | Web height (mm) | Flange width (mm) | Draft (mm) |
|---|---|---|---|---|---|---|
| 10 | 1 | 180 | 240 | 930 | 420 | 40 |
| 11 | 2 | 210 | | 948 | 418 | 30 |
| 12 | 2 | 180 | | 968 | 416 | 30 |
| 13 | 4 | 180 | | 945 | 426 | 23 |
| 14 | 4 | 180 | | 915 | 440 | 30 |
| 15 | 1 | 140 | | — | 432 | 40 |
| 16 | 1 | 110 | 170 | 930 | 402 | 30 |
| 17 | 2 | 135 | | 975 | 402 | 35 |
| 18 | 2 | 110 | | 1,016 | 401 | 25 |
| 19 | 3 | 110 | | 995 | 404 | 21 |
| 20 | 3 | 110 | | 970 | 408 | 25 |
| 21 | 3 | 110 | | 945 | 412 | 25 |
| 22 | 3 | 110 | | 920 | 416 | 25 |
| 23 | 1 | 85 | | — | 377 | 25 |
| 24 | 1 | 75 | 107 | 930 | 367 | 10 |
| 25 | 2 | 87 | | 970 | 365 | 2 |
| 26 | 2 | 75 | | 998 | 364 | 12 |
| 27 | 3 | 75 | | 980 | 367 | 18 |
| 28 | 3 | 75 | | 960 | 370 | 20 |
| 29 | 3 | 75 | | 940 | 373 | 20 |
| 30 | 3 | 75 | | 920 | 376 | 20 |
| 31 | 1 | 75 | | 930 | 367 | 0 |

(1) Pass No. 1-2: The edge-rolling was performed from 1,225 mm to 1,185 mm a15 by 2 passes (1) Pass No. 1-2: The edge-rolling was performed from 1,225 mm to 1,185 mm at drafts of 5 mm per pass and 35 mm per pass by 2 passes through a caliber No. 5 having a caliber width substantially equal to the thickness of the slab, .during which V-shape recess was formed in the center of each short side of the slab. And also, the maximum width of the flange portion was extended from 250 mm to about 272 mm.

(2) Pass No. 3-8: The edge-rolling was performed from 1,185 mm to 910 mm at a draft of 40-50 mm per pass by 6 passes through a caliber No. 4, whereby the flange width was further extended from 272 mm to 423 mm. In this case, the thickness of the slab hardly changed at a central region of the slab not influenced by the edge-rolling.

(3) Pass No. 9-10: After the above edge-rolling, the material was turned around 90° and rolled at a draft of 70 mm by 2 passes through a caliber No. 1 comprising a pair of rolling collars 16 separated by a relief 18, which serve to roll only the region of the web portion near the joint of the flange portion. In this case, the central region of the web portion formed a convex part due to no influence of the rolling, while the flange width was shortened by about 3 mm to be 420 mm due to the stretching of the material because the flange portion was not sufficiently filled in a flange part of the caliber (leg length 146 mm). Thus, the web height was extended to substantially be equal to the caliber width and was 930 mm. Moreover, the web thickness $t_1$ was 180 mm, while the web thickness $t_2$ was 240 mm.

(4) Pass No. 11-12: Only the convex part of the web portion was rolled by 2 passes through a caliber No. 2 comprising a rolling drum 20 until the web thickness $t_2$ was equal to the web thickness (180 mm) after the partial rolling by the caliber No. 1. In this case, the stretching of the web portion in the lengthwise direction was restricted by the non-rolled regions of the web portion and the flange portion, so that metal of the convex part flowed in a transverse direction (or a direction perpendicular to the stretching). As a result, the web height was increased by 38 mm from 930 mm to 968 mm.

(5) Pass No. 13–14: In order to further enlarge the flange width, the material was turned around 90° and again edge-rolled from 968 mm to 915 mm by the caliber No. 4, whereby the flange width was increased by 24 mm from 416 mm to 440 mm.

(6) Pass No. 15–30: The rolling of the above items (3)–(5) was repeated two times by Pass Nos. 15–22 and Pass Nos. 23–30 to regulate the flange width, web thickness and web height. In this case, the edge-rolling for the item (3) was carried out by using a caliber No. 3 having a flat bottom (no belly) in order to remove the V-shape recess from the material. In the later case, the flange width was not enlarged as compared with the case of using caliber No. 4.

(7) Pass No. 31: Only the flange portion was shaped by the caliber No. 1 without rolling the regions of the web portion near the joint of the flange portion, whereby the beam blank was finished.

EXAMPLE B

Beam blanks for H800×300 and H900×300 were manufactured from the same slab as used in Example A in the same manner as described in Example A and then transferred into a universal roll mill to produce final products.

In the beam blanks for H800×300 and H900×300, the web height was about 100 mm and 200 mm higher than that for H700×300. Therefore, the height of the convex part was controlled in Pass Nos. 23 and 24 of Table 1 and then the web height was enlarged to 1,030 mm and 1,130 mm in the rolling of the convex part by Pass Nos. 25 and 26, whereby the desired beam blanks were manufactured. In this case, the rolling on and after Pass No. 27 became disused.

As apparent from the above, the beam blanks having different sizes can easily be manufactured by some alterations of the pass schedule.

In the roll to be used for the above rolling stages, five kinds of calibers including three box calibers No. 1, 4 and 5 are required, so that the drum length L is fairly long as shown in FIG. 10. For instance, in case of rolling the beam blank for H700×300, the width of the caliber No. 5 for centering is approximately 270 mm, the width of the caliber No. 4 for the enlargement of flange width is approximately 500 mm, the width of the caliber No. 2 for the enlargement of web height is approximately 1,100 mm, the width of the flat box caliber No. 3 is about 500 mm and the width of the shaping caliber No. 1 is 930 mm, so that the drum length L of the roll is as fairly long as about 4,000 mm.

However, the depth of the relief 18 required in the shaping caliber No. 1 is 270 mm, so that the caliber No. 1 serves as a centering caliber No. 5 by disposing a belly 13 on the groove bottom of the relief 18. Further, one of reliefs 21, 21 sandwiching the rolling drum 20 in the caliber No. 2 can serve as a box caliber 14 having belly 15 by disposing the belly 15 on the groove bottom of the relief 21, while the other relief 21 can serve as a flat box caliber 14' (see FIG. 11).

Figure 11:
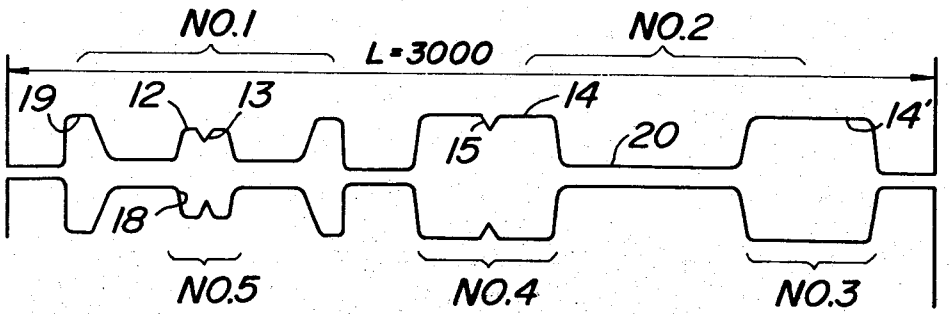
FIGS. 11–14 are schematic views of another embodiments in the pattern of the rolling roll according to the invention, respectively.

Thus, the drum length L of the roll shown in FIG. 11 can be shortened by 1,000 mm from the roll of FIG. 10 by overlapping the calibers with each other and is about 3,000 mm.

Figure 12:
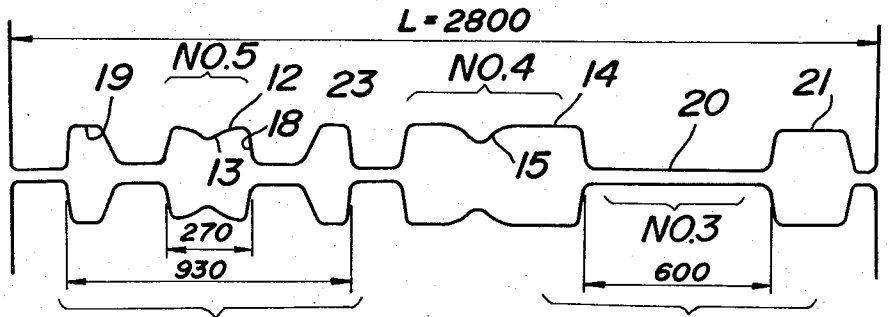

In another embodiment of the roll, the edge-rolling by the box caliber 14' of FIG. 11 is carried out by the rolling drum 20 of the caliber No. 2 for the enlargement of web width as shown in FIG. 12, whereby the drum length L is further shortened to 2,800 mm.

Figure 13:
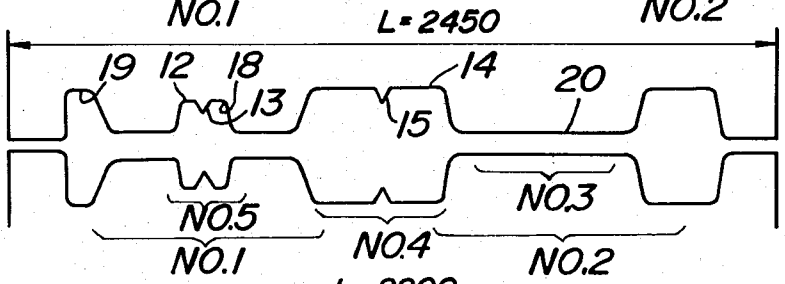

When a flange part 23 in the shaping caliber No. 1 of the roll of FIG. 12 is overlapped with the caliber 14 for the enlargement of flange width, the drum length L of the roll is shortened to 2,450 mm as shown in FIG. 13. In this case, one side of the flange portions in the rolled material is not restricted during the rolling by the shaping caliber 17, so that it is necessary that both flange portions are alternately shaped by turning the material around 180° every 1–3 pass.

Figure 14:
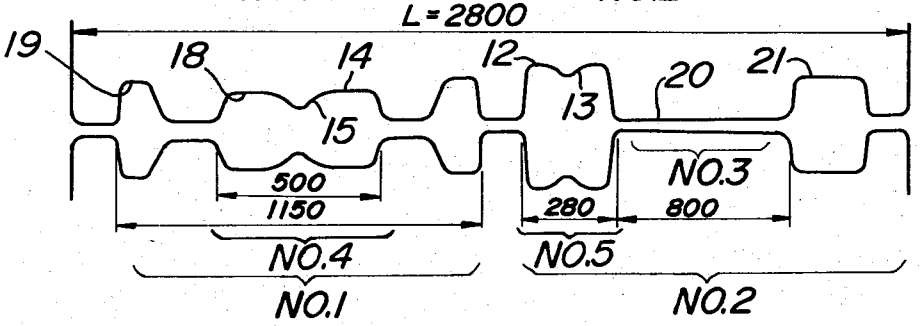

Moreover, when the caliber width of the shaping caliber 17 is large, the caliber 12 may be replaced with the caliber 14 as shown in FIG. 14.

What is claimed is:

1. A method of rolling raw materials inclusive of slabs for the manufacture of beam blanks, which comprises the steps of (a) subjecting a raw material whose section consists of a web portion and a flange portion, to a partial rolling such that said web portion is partially rolled at regions inclusive of at least joints of said flange portion, except a remaining central region among a plurality of regions divided in the widthwise direction of said web portion, and (b) subjecting only the remaining central region to a rolling without rolling said regions rolled in the above step (a).

2. A method of rolling raw materials inclusive of slabs for the manufacture of beam blanks, which comprises the steps of (a) subjecting a raw material, whose section consists of a web portion and a flange portion having a width wider than the thickness of said web portion, to a partial rolling such that said web portion is partially rolled at regions inclusive of at least joints of said flange portion, except a remaining central region among a plurality of regions divided in the widthwise direction of said web portion.

(b) subjecting only the remaining central region to a rolling, without rolling said regions rolled in the above step (a), (c) subjecting said flange portion to a rolling by pressing said flange portion toward said web portion, and (d) repeating each of the steps (a), (b) and (c) at one or more passes.

3. The method according to claim 2, wherein said partial rolling comprises shaping caliber rolling of said flange portion.

4. A roll for rolling raw materials inclusive of slabs for the manufacture of beam blanks, which includes a single cylindrical drum comprising a first segment and a second segment arranged side by side to each other, said first segment having at least one relief of circumferential grooves facing a web portion of raw material having a sectional shape consisting of a web portion divided in the widthwise direction into a plurality of regions, and a flange portion having a width wider than the thickness of said web portion, a plurality of rolling collars separated apart from each other by said at least one relief in the axial direction and serving for a partial rolling such that said web portion is partially rolled at regions inclusive of at least joints of said flange portion, except a remaining central region among the plurality of regions of said web portion, and a circumferential groove dividing a side of one of said rolling collars for said web portion near the joints of said flange portion and enclosing said flange portion, and said second segment having a pair of reliefs each comprising a wider circumferential groove facing said flange portion, and a rolling drum extending between said pair of reliefs and serving for a rolling of the remaining central region of said web portion.

5. The roll according to claim 4, wherein, each of said pair of reliefs of said second segment comprises a caliber for rolling of said flange portion under the rolling of said web portion in the widthwise direction.

* * * * *